US006242995B1

(12) United States Patent
Shikama et al.

(10) Patent No.: US 6,242,995 B1
(45) Date of Patent: Jun. 5, 2001

(54) BEAD INDUCTOR AND METHOD OF MANUFACTURING SAME

(75) Inventors: Takashi Shikama, Yokaichi; Masami Sugitani, Omihachiman; Hisato Oshima, Yokaichi, all of (JP)

(73) Assignee: Murata Manufacturing Co., LTD

( * ) Notice: Subject to any disclaimer, the term of this patent is extended or adjusted under 35 U.S.C. 154(b) by 0 days.

(21) Appl. No.: 09/332,694

(22) Filed: Jun. 14, 1999

(30) Foreign Application Priority Data

Jun. 18, 1998 (JP) ..... 10-171120

(51) Int. Cl.[7] ..... H01F 17/04; H01F 17/06
(52) U.S. Cl. ..... 336/175; 336/172
(58) Field of Search ..... 336/96, 175, 212, 336/233, 92, 172

(56) References Cited

U.S. PATENT DOCUMENTS 5,669,134 * 9/1997 Nogi et al. ..... 29/605
5,896,079 * 4/1999 Parker ..... 336/221
6,055,721 * 5/2000 Mamada et al. ..... 29/605

FOREIGN PATENT DOCUMENTS 42 20 194 12/1993 (DE) .

OTHER PUBLICATIONS

Japanese Abstract 60–39814 (Mar. 1985), "Manufacture of Chip Inductor."

* cited by examiner

*Primary Examiner*—Anh Mai
(74) *Attorney, Agent, or Firm*—Keating & Bennett, LLP

(57) ABSTRACT

A method of manufacturing a bead inductor includes the steps of forming a molded body of a resin material or a rubber material including a powdery magnetic substance with a conductor coil defined by a wound, coated metallic wire; cutting both ends of the molded body so as to expose the ends of the conductor coil; and attaching external terminals to the exposed ends of the conductor coil so that the external terminals are electrically connected to the conductor coil. The connection reliability between the conductor coil and the external terminals is greatly increased in the bead inductor manufactured by the method because convex portions protruding from the end surfaces of the molded body are provided on both ends of the conductor coil, which are exposed by cutting the molded body, so that the external terminals are attached and electrically connected to the convex portions.

20 Claims, 5 Drawing Sheets

BEAD INDUCTOR AND METHOD OF MANUFACTURING SAME

BACKGROUND OF THE INVENTION

1. Field of the Invention

The present invention relates to a method of manufacturing a bead inductor and a bead inductor produced by such method such that the bead inductor is adapted for use in a noise controlling circuit and other circuits.

2. Description of the Related Art

As a noise-controlling device, especially a device for use with a microprocessor, for example, which is required to pass a large electric current therethrough, an experimental bead inductor has been proposed and tested. Such a bead inductor is an example of an experimental device which has not been publicly disclosed and is formed of a resin material or a rubber material including a powdery magnetic substance such as ferrite powder having a conductor coil embedded therein. In such a bead inductor, a conductor coil is embedded into a resin material or a rubber material via injection molding or other process, to form a molded body which is cut off at both ends thereof to expose both ends of the coil disposed therein. Then, metal caps are connected thereto via conductive resin paste or spot welding so as to define external terminals.

FIGS. 5 and 6 are sectional views illustrating a method for manufacturing the bead inductor. Referring to FIGS. 5 and 6, a metallic mold for injection molding to manufacture the bead inductor includes an upper mold 1 and a lower mold 2. A cavity is formed in the upper mold 1 and defines a space for molding a resin member. In the lower mold 2, a pin 4 is provided so as to be disposed in the cavities 3 when the upper mold 1 and the lower mold 2 are mated with each other. The upper mold 1 has a gate 1*a* for supplying a melted resin material into the cavity 3.

In order to manufacture a molded body of the bead inductor using the metallic mold shown in FIG. 5, the pin 4 is inserted into a conductor coil, which is formed by winding a metallic wire such as a copper wire coated by a polyester resin, etc., for insulation. Then, the melted resin including a powdery magnetic substance such as ferrite powder is injected into the cavity 3 via the gate 1*a*. As a result, the outer portion of the conductor coil having the pin 4 inserted therein is molded of the melted resin.

FIG. 6 is a sectional view showing the state of the outside portion of a coil 5 molded in this manner. After the step shown in FIG. 5, the pin 4 is removed and the same resin material used for the outside portion of the coil 5 is injected into the space produced by the removing the pin 4, so as to mold the inside of the coil 5 of the melted resin, so that the coil 5 is embedded in the resin.

Both ends of the molded body obtained in this manner are cut off by a dicing saw or other cuffing instrument, such that the ends of the coil embedded in the resin of the molded body are exposed.

FIG. 7 is a side view showing the molded body after the cutting step described above is performed and FIG. 8 is a plan view thereof. A molded body 7 is formed by embedding the conductor coil 5 into a resin molding 6. On one of the cutting planes 7*a* of the molded body 7, one end portion 5*a* of the conductor coil 5 is exposed. On the other of the cutting planes 7*b* of the molded body 7, the other end portion 5*b* of the conductor coil 5 is exposed. In a conventional manufacturing method, metallic caps which define external terminals are attached so that the end portions 5*a* and 5*b* of the conductor coil 5 are electrically connected thereto via conductive resin paste or spot welding. Solder may be used to attach the metallic cap, and in this case, solder paste, etc., is coated on the end portions of the conductor coil exposed on the end planes of the molded body or on the metallic caps.

In a conventional bead inductor, the conductor coil inside of the molding is electrically connected to the external terminal via conductive resin paste, spot welding, etc., as described above. As a result, there has been a problem of a low degree of reliability in the electrical connection between the conductor coil and the external terminal. That is, it is difficult to secure the spot welding on the ends 5*a* and 5*b* of the conductor coil 5 in the respective cutting planes 7*a* and 7*b* of the molded body 7, because the surfaces of the ends are flat as shown in FIG. 7, resulting in a low degree of reliability of the electrical connection when the external terminal such as a metal cap is welded thereon. When the external terminals such as the metal caps are bonded onto the ends 5*a* and 5*b* of the conductor coil 5 via conductive resin paste, the connecting reliability is also low because of poor adhesive properties.

SUMMARY OF THE INVENTION

To overcome the problems described above, preferred embodiments of the present invention provide a method of manufacturing a bead inductor and a bead inductor produced by such method such that the connection reliability between the conductor coil and the external terminal is greatly improved.

In accordance with one preferred embodiment of the present invention, a method of manufacturing a bead inductor includes the steps of forming a molded body of at least one of a resin material and a rubber material including a powdery magnetic substance, the molded body having a conductor coil including a wound coated metallic wire embedded therein; cutting both ends of the molded body so as to expose ends of the conductor coil; forming convex portions on the ends of the conductor coil, which are exposed by the cutting step; and attaching external terminals to the convex portions so that the external terminals are electrically connected to the conductor coil.

Because the convex portion is provided at the end of the conductor coil, the connection by spot welding or soldering is much easier and much more reliable so as to further securely connect the conductor coil to the external terminal electrically. Therefore, the connecting reliability between the conductor coil and the external terminal is greatly increased.

The step of forming convex portions according to a preferred embodiment of the present invention may be achieved by plating the ends of the conductor coil. The method of plating is not specifically limited. Electrolytic plating or electroless plating may be utilized. In the case of the electrolytic plating, the plating may be performed with a plurality of layers, for example. In order to improve solder wetting properties in spot welding or soldering, after Ni layer plating is performed, Sn layer plating may be performed thereon.

The step of forming convex portions according to a preferred embodiment of the present invention may be achieved by applying solder onto the ends of the conductor coil. As a method for applying solder, for example, the convex portions made of solder may be formed by immersing the ends of the conductor coil on the surface of the molded body into a melting soldering bath after coating flux thereon so as to deposit the solder on the ends of the conductor coil.

In accordance with a preferred embodiment of the present invention, when the step of forming convex portions is achieved by applying solder onto the ends of the conductor coil, solder having a high melting point may be utilized. When the inductor is mounted on a substrate via flow and reflow soldering, standard solder can be used for forming the convex portion. When occasion demands that the inductor is soldered on a substrate at a high temperature, it is preferable that the convex portion be formed of solder having a high melting point, which is the so-called high-temperature solder.

The step of forming convex portions according to a preferred embodiment of the present invention may be achieved by sandblast treating the ends of the molded body so as to expose the ends of the conductor coil by scraping the surfaces of the ends of the molded body. Because the convex portion is formed so that the conductor coil is exposed to protrude by scraping the surfaces of the ends of the molded body, there is no possibility of exfoliation of the convex portion, which results in further improvement of connecting reliability. In addition, when the end surface of the molded body is treated via sandblasting, insulation coating on the exposed conductor coil is also removed by sandblasting to improve the electrical connection.

In accordance with another preferred embodiment of the present invention, a bead inductor includes a conductive coil defined by a wound, coated metallic wire; a molded body formed of at least one of a resin material and a rubber material including a powdery magnetic substance such that the conductor coil is embedded in the molded body so that ends of the conductor coil are exposed at both ends of the molded body; convex portions formed on the exposed ends of the conductor coil at both ends of the molded body so as to be electrically connected thereto; and external terminals attached to each of the both ends of the molded body so as to be electrically connected to the convex portions. The bead inductor according to this preferred embodiment of the present invention can be manufactured by the manufacturing method in accordance with the preferred embodiment described above.

The external terminals according to the second preferred embodiment of the present invention may be defined by metallic caps fitted to the both ends of the molded body.

These and other elements, features, and advantages of the preferred embodiments of the present invention will be apparent from the following detailed description of the preferred embodiments of the present invention, as illustrated in the accompanying drawings.

DETAILED DESCRIPTION OF PREFERRED EMBODIMENTS

Figure 1:
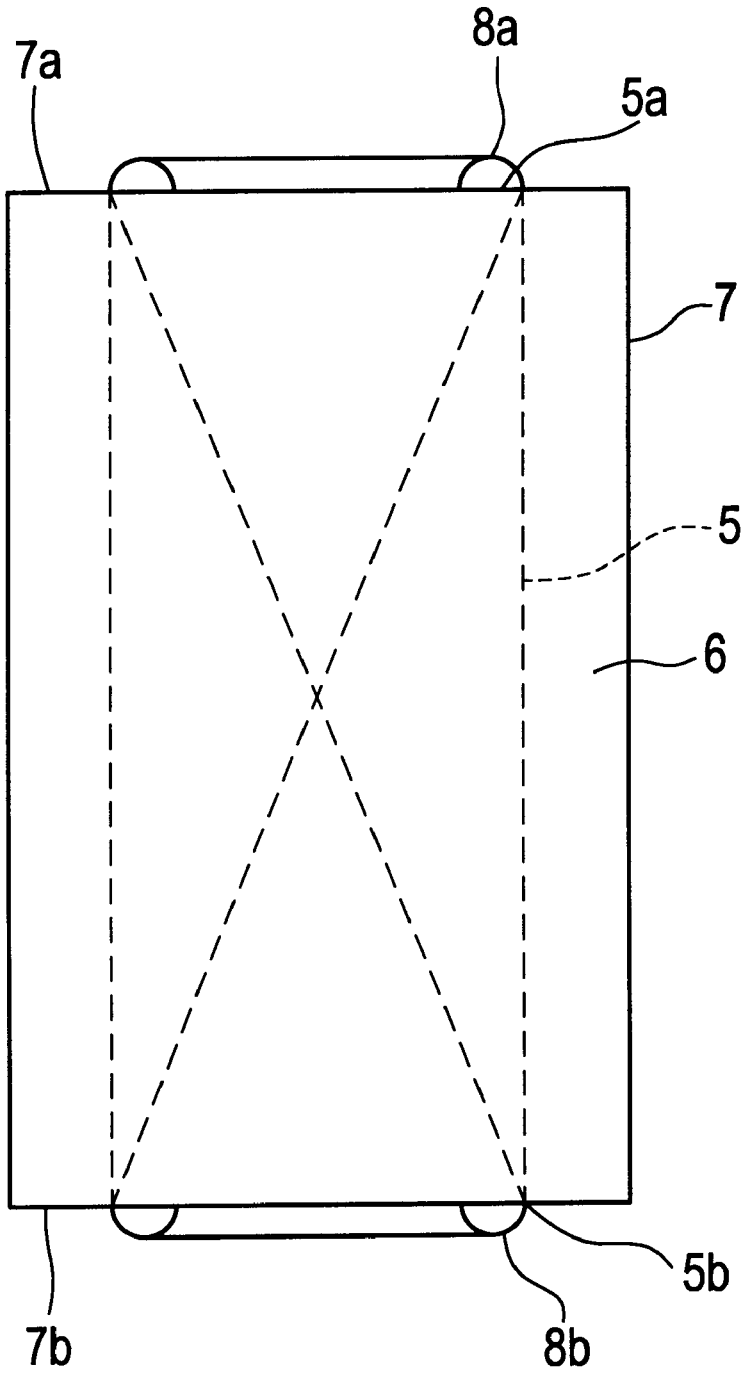
FIG. 1 is a side view showing a molded body having convex portions provided thereon according to a preferred embodiment of the present invention.
Figure 2:
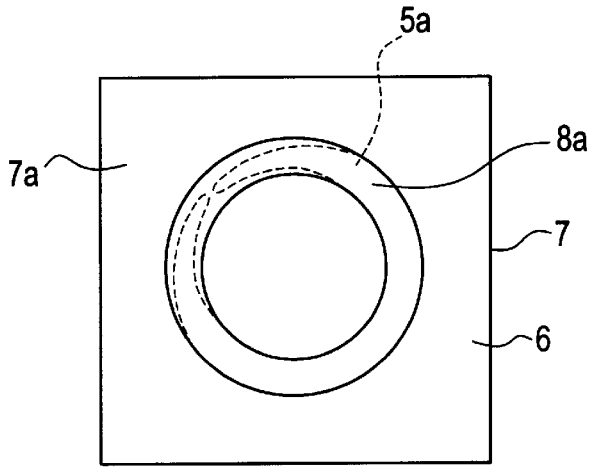
FIG. 2 is a plan view showing the molded body having the convex portions provided thereon according to a preferred embodiment of the present invention.

FIG. 1 is a side view showing a molded body having convex portions according to a preferred embodiment of the present invention, while FIG. 2 is a plan view thereof. The molded body shown in FIGS. 1 and 2 is obtained by forming convex portions 8*a* and 8*b* on both ends 5*a* and 5*b* of a conductor coil 5 of a molded body 7, shown in FIGS. 7 and 8, which molded body may be otherwise produced by a conventional manufacturing process. The convex portions 8*a* and 8*b* preferably have a substantially annular shape along the ends 5*a* and 5*b* of the conductor coil, respectively, as shown in FIG. 2.

Figure 7:
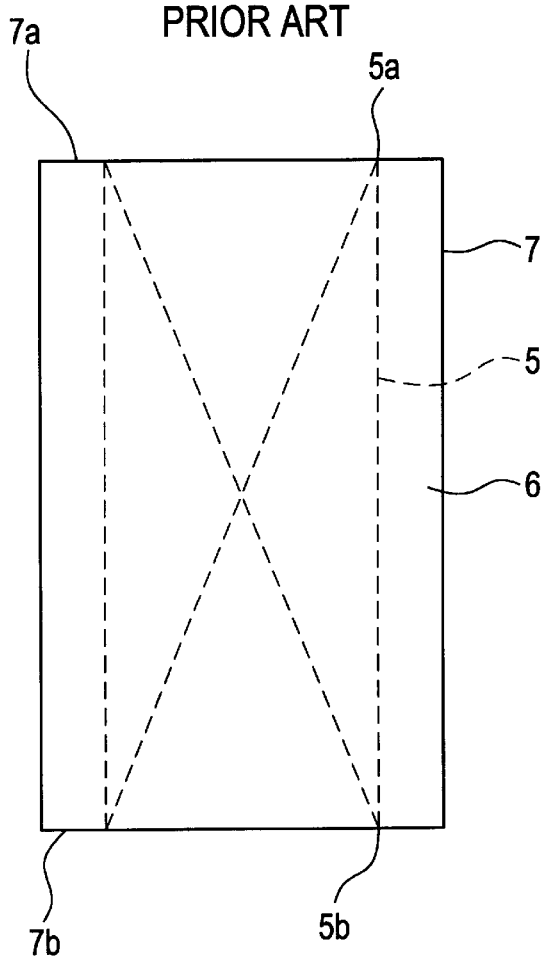
FIG. 7 PRIOR ART
FIG. 7 is a side view showing a conventional molded body.
Figure 8:
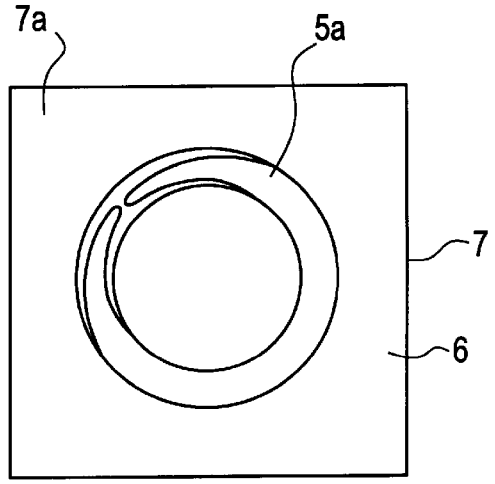
FIG. 8 PRIOR ART
FIG. 8 is a plan view showing the conventional molded body of FIG. 7.

In the case that the convex portions 8*a* and 8*b* are formed by electrolytic plating, for example, the convex portions can be formed by electrolytic plating, immersing the molded body shown in FIGS. 7 and 8 in an electrolytic plating bath so that the conductive coil is connected thereto so as to define the terminals.

If the convex portions 8*a* and 8*b* are formed via soldering, the convex portions 8*a* and 8*b* made of solder can be formed by coating flux on the ends 5*a* and 5*b* of the conductor coil 5 which is exposed to cutting planes 7*a* and 7*b* of the molded body 7 and by immersing the ends 5*a*, 5*b* into a melting soldering bath so as to deposit the solder on the ends 5*a* and 5*b*.

In the case that the convex portions 8*a* and 8*b* are formed via sandblasting, the cutting planes 7*a* and 7*b* of the molded body 7 are treated via sandblasting, respectively. The surfaces of the resin molding 6 on the cutting planes 7*a* and 7*b* of the molded body 7 are scraped such that the ends 5*a* and 5*b* of the conductor coil 5 are exposed so as to protrude. The ends 5*a* and 5*b* exposed in this manner are configured to define the convex portions 8*a* and 8*b*, respectively. The exposed portion is coated by a thin insulating film thereon because the conductor coil 5 is formed of a coated metallic wire. Because the thin insulating film is removed via sandblasting, the interior metallic wire is exposed at the surfaces of the convex portions 8*a* and 8*b*.

Figure 3:
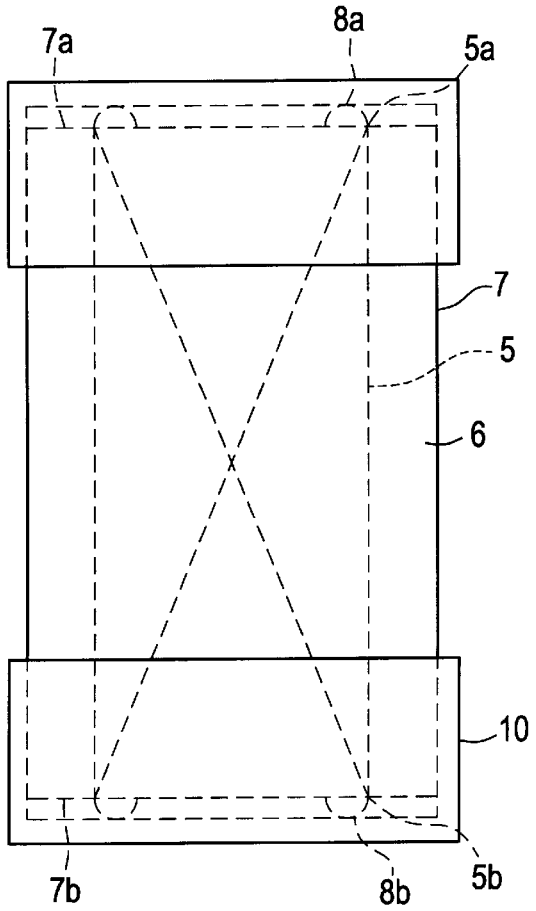
FIG. 3 is a side view showing a bead inductor according to a preferred embodiment of the present invention.
Figure 4:
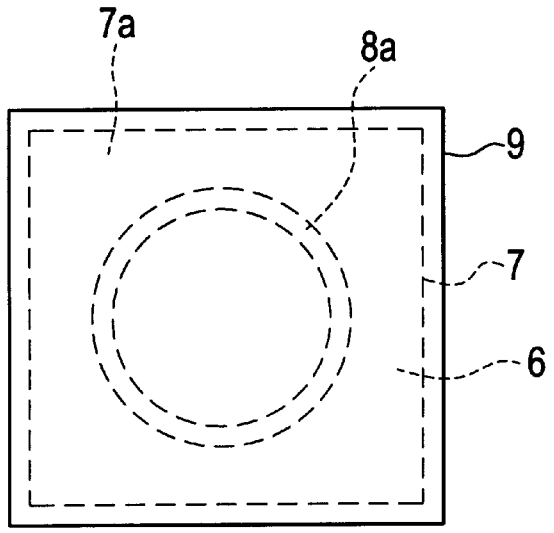
FIG. 4 is a plan view showing the bead inductor according to a preferred embodiment of the present invention.
Figure 5:
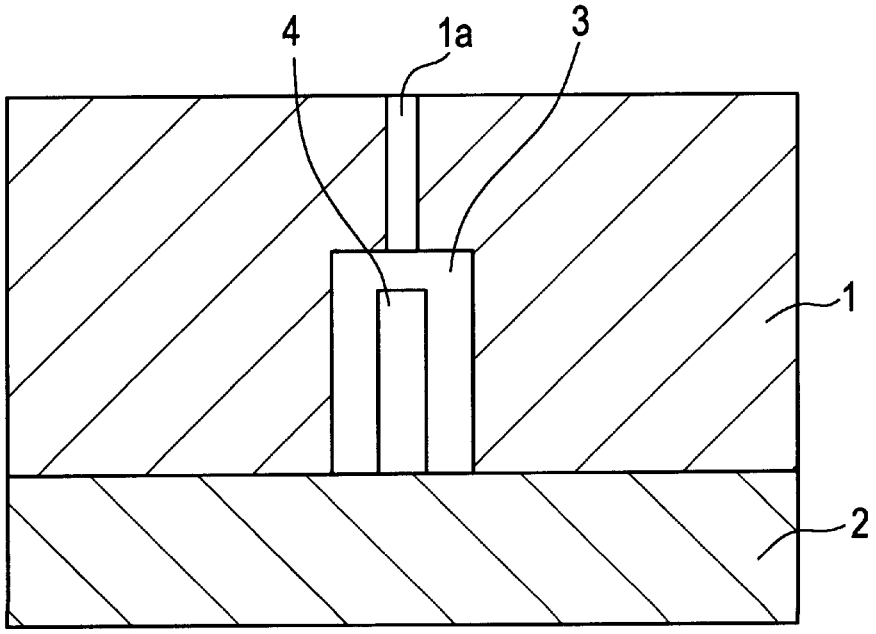
FIG. 5 PRIOR ART
FIG. 5 is a sectional view showing a metallic mold for injection molding which is used to form molded body with a conductive coil embedded therein.
Figure 6:
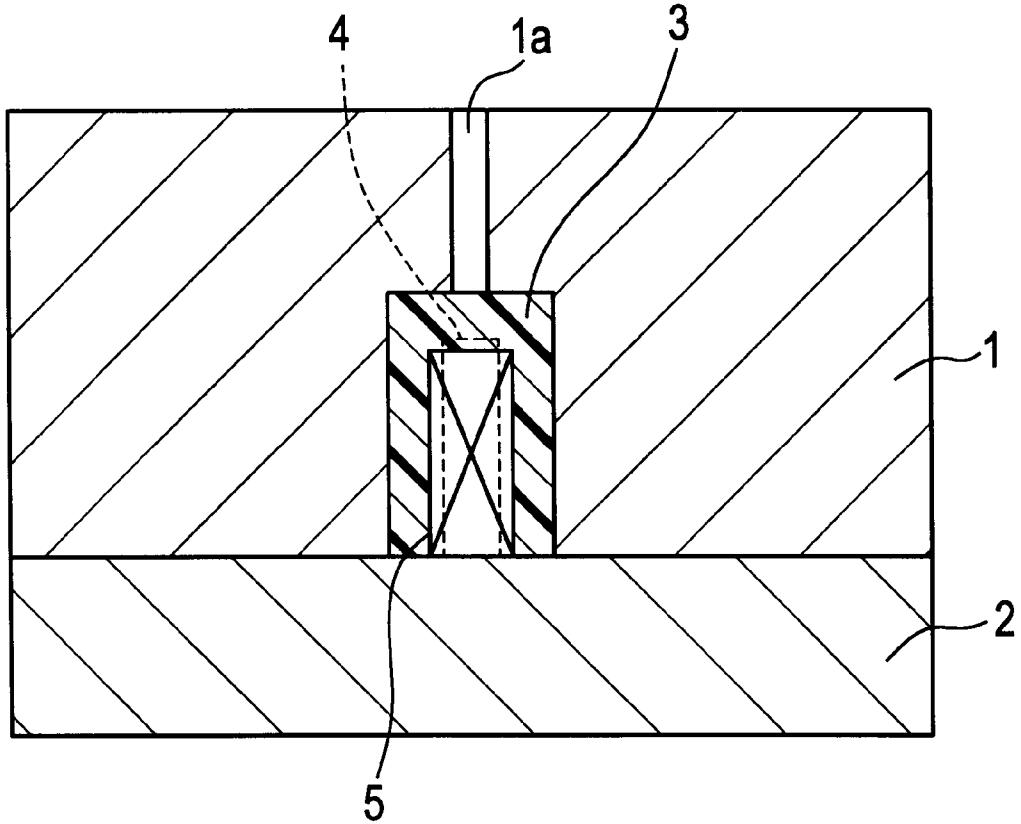
FIG. 6 PRIOR ART
FIG. 6 is a sectional view showing the metallic mold for injection molding which is used to form the molded body with the conductive coil embedded therein and the portion of the molded body outside of the coil.

FIGS. 3 and 4 are a side view and a plan view, respectively, showing the state in which metallic caps 9 and 10 are attached to both ends of the molded body 7 shown in FIGS. 1 and 2 so as to define the bead inductor. As shown in FIG. 3, the metallic cap 9 is disposed so as to contact and to be electrically connected to the convex portion 8*a* on the end 5*a* of the conductor coil 5. The metallic cap 10 is also disposed so as to contact and to be electrically connected to the convex portion 8*b* on the end 5*b* of the conductor coil 5.

As for the method of attaching the metallic caps 9 and 10 so as to be electrically connected, methods such as spot welding and soldering may be used. A coating of conductive paste may be also used.

Because the convex portions 8*a* and 8*b* of both ends of the molded body 7 protrude from the cutting planes 7*a* and 7*b* as shown in FIG. 3, spot welding and soldering are easily performed as well as coating of conductive paste, etc. Therefore, the metallic caps 9 and 10 can be attached in conditions which secure sufficient electrical connectibility.

As described above, when the metallic caps are attached to the convex portions 8*a* and 8*b*, spot welding, soldering, coating of conductive paste, etc. can be utilized. When the convex portion is formed of solder, the metallic cap is abutted to the convex portion to be heated as it is, so that the metallic cap can be attached by melting the solder.

While in the above-described preferred embodiments, a resin material including a powdery magnetic substance has been explained as a preferred material defined by a resin including ferrite powder for an example, the present invention is not limited to this powder. A resin material including other various powdery magnetic substances may be used. A rubber material including a powdery magnetic substance may be also used.

In accordance with preferred embodiments of the present invention, by forming convex portions on the ends of the conductor coil in the molded body after cutting, the electrical connection between the convex portions and external terminals is greatly improved. Therefore, the connection between the conductor coil and the external terminal via spot welding, adding solder, coating conductive paste, etc., is easily performed and more securely and reliably connects the conductor coil to the external terminal electrically. Accordingly, the connecting reliability between the conductor coil and the external terminal is greatly increased.

The step of forming convex portions according to preferred embodiments of the present invention may be achieved by plating the ends of the conductor coil. This also increases the connecting reliability between the conductor coil and the external terminal.

In accordance with preferred embodiments of the present invention, when the step of forming convex portions is achieved by adding solder onto the ends of the conductor coil, the connecting reliability between the conductor coil and the external terminal is greatly increased. Because the convex portion is formed of solder, when the convex portion is connected to the external terminal, soldering can be achieved by heating the convex portion to melt the solder thereof.

In accordance with preferred embodiments of the present invention, when the step of forming convex portions is achieved by adding solder onto the ends of the conductor coil, by using solder having a high melting point, the convex portions may be formed when the inductor is mounted on a substrate at a higher temperature than a general flow and reflow soldering temperature.

According to preferred embodiments of the present invention, the convex portion may be formed by sandblast treating ends of the molded body so as to expose the ends of the conductor coil by scraping the surfaces of the ends of the molded body. This also increases the connecting reliability between the conductor coil and the external terminal.

In accordance with another preferred embodiment of the present invention, because the external terminals are disposed so as to be electrically connected to the convex portions located at the exposed ends of the conductor coil at both ends of the molded body, the connecting reliability between the conductor coil and the external terminal is greatly increased.

The external terminals according to the another preferred embodiment of the present invention may be conventionally generally used metallic caps to define the external terminals. This allows a chip inductor having a high degree of connection reliability between the metallic cap defining an external terminal and the conductor coil to be achieved.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A method for manufacturing a bead inductor, the method comprising the steps of:

forming a molded body of at least one of a resin material and a rubber material including a powdery magnetic substance, the molded body having a conductor coil embedded therein;

cutting both ends of the molded body so as to expose ends of the conductor coil;

forming convex portions on the ends of the conductor coil, which is exposed by said cutting step; and attaching external terminals to the convex portions so that the external terminals are electrically connected to the conductor coil.

2. A method according to claim 1, wherein the conductor coil is defined by a wound, coated metallic wire.

3. A method according to claim 1, wherein the convex portions have a substantially annular configuration.

4. A method according to claim 1, wherein said step of forming convex portions is achieved by plating the ends of the conductor coil.

5. A method according to claim 4, wherein the plating step includes electrolytic plating.

6. A method according to claim 4, wherein the plating step includes electroless plating.

7. A method according to claim 4, wherein the plating step includes Ni layer plating and Sn layer plating.

8. A method according to claim 1, wherein said step of forming convex portions is achieved by applying solder onto the ends of the conductor coil.

9. A method according to claim 8, wherein the solder is applied by immersing the ends of the conductor coil into a molten solder bath.

10. A method according to claim 8, wherein said step of forming convex portions is achieved by applying solder having a high melting point.

11. A method according to claim 1, wherein said step of forming convex portions is achieved by sandblast treating the ends of the molded body so as to expose ends of the conductor coil by scraping the surfaces of the ends of the molded body.

12. A method according to claim 11, wherein the conductor coil including coating thereon and the coating on exposed portions of the conductor coil are removed via the sandblasting treating.

13. A method according to claim 1, wherein the step of attaching external terminals includes the step of spot welding the external terminals to the convex portions.

14. A method according to claim 1, wherein the step of attaching external terminals includes the step of soldering the external terminals to the convex portions.

15. A bead inductor comprising:

a conductive coil;

a molded body made of at least one of a resin material and a rubber material including a powdery magnetic substance, said conductor coil being embedded in the molded body so that the ends of said conductor coil are exposed at both ends of said molded body;

convex portions disposed at the exposed ends of said conductor coil at both ends of said molded body so as to electrically connected to the conductor coil; and external terminals attached to each of the both ends of said molded body so as to electrically connected to said convex portions.

16. A bead inductor according to claim 15, wherein said external terminals are metallic caps which are respectively fitted to both ends of said molded body.

17. A bead inductor according to claim 15, wherein said convex portions have a substantially annular configuration.

18. A bead inductor according to claim 15, wherein the conductor coil is defined by a wound, coated metallic wire.

19. A bead inductor according to claim 15, wherein said convex portions are made of solder.

20. A bead inductor according to claim 15, wherein said convex portions comprise sandblasted portions of the conductor coil.

* * * * *